US005263598A

United States Patent [19]

Vortherms

[11] Patent Number: 5,263,598

[45] Date of Patent: Nov. 23, 1993

[54] STORAGE RACK

[75] Inventor: Kenneth A. Vortherms, St. Charles, Mo.

[73] Assignee: Prest Rack Inc., Warrenton, Mo.

[21] Appl. No.: 886,622

[22] Filed: May 21, 1992

[51] Int. Cl.[5] ..... A47F 5/00

[52] U.S. Cl. ..... 211/191; 211/189

[58] Field of Search ..... 211/189, 190, 191, 192, 211/187

[56] References Cited

U.S. PATENT DOCUMENTS

| | | | |
|---|---|---|---|
| 2,925,920 | 2/1960 | Skubic | 211/191 X |
| 3,009,582 | 11/1961 | Degener | 211/177 |
| 3,142,386 | 7/1964 | Skubic | 211/191 |
| 4,074,812 | 2/1978 | Skubic et al. | 211/191 X |
| 4,189,250 | 2/1980 | Abbott et al. | 403/190 |
| 5,131,781 | 7/1992 | Klein | 211/192 X |

*Primary Examiner*—Robert W. Gibson, Jr.

*Attorney, Agent, or Firm*—Senniger, Powers, Leavitt & Roedel

[57] ABSTRACT

A rack having four vertical posts arranged at the corners of a rectangle, and having at least one beam extending horizontally between the two posts at each of the long sides of the rectangle. A connector is provided at each end of the beam for connecting the beam at each end thereof to the respective posts. The connector comprises a metal plate bent to have first and second legs at right angles to one another and a bulged-out juncture between the legs.

A method for making the connector is further disclosed.

17 Claims, 5 Drawing Sheets

STORAGE RACK

BRIEF SUMMARY OF THE INVENTION

This invention relates to storage racks, and more particularly to a storage rack of the type comprising posts, beams and other parts which are usually assembled at the place of use.

The invention is generally in the same class as the storage racks shown in U.S. Pat. Nos. 3,009,582 and 4,189,250, comprising vertical posts and beams extending horizontally between posts with means at the ends of the beams for connecting them to the posts.

Among the several objects of the invention may be noted the provision of a storage rack having improved and simplified means for connecting the beams of the rack at their ends to the two posts between which the beams extend, said connecting means being not only a relatively low-cost means but also one that enables quick and easy connection of the beams to the posts with a snug fit, added strength and proper alignment and without the need for use of shims to attain the fit and alignment; the provision of a rack with connector means comprising a low-cost connector which, while being formed in one piece of sheet metal for economy, is adapted for easy attachment to a post with proper fit; and the provision of a method for economical manufacture of the connectors.

In general, a rack embodying the present invention comprises four vertical posts arranged at the corners of a rectangle and at least one beam extending horizontally between the two posts at each of the long sides of the rectangle. Each post is of such transverse cross section as to have a first face facing toward the opposite end of the rectangle and a second face at right angles to the first face. Means for connecting each beam at each end thereof to the posts is further provided along with means for holding the posts in position at the corners of the rectangle. The connecting means at each end of the beam comprises a metal plate bent to angle shape in transverse section to have first and second legs at right angles to one another and a bulged-out juncture for the legs. The first leg of each connecting means is secured at the outside thereof to the end of the respective beam extending transversely with respect to the beam at right angles to the beam with the inside face of said first leg in flatwise engagement with the first face of the post. The second leg of each connecting means extends outwardly from the end of the beam in a vertical plane parallel to the vertical endwise plane of the beam with its inside face in flatwise engagement with the second face of the post. Additionally provided are means for fastening the second leg of each connecting means to the post.

The connecting means for connection of the end of a beam to a post of a rack comprises a one-piece member constituted by a sheet metal plate originally of rectangular shape bent along a line extending from one end of the plate to the other to be of angle shape in transverse cross section, thereby having first and second legs at right angles to one another and further having a bulged-out juncture for the legs. The connector member is made by bending the sheet metal plate along the line to form it to the angle shape in transverse section with the first and second legs, and applying pressure at the juncture of the legs to bulge out the juncture.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
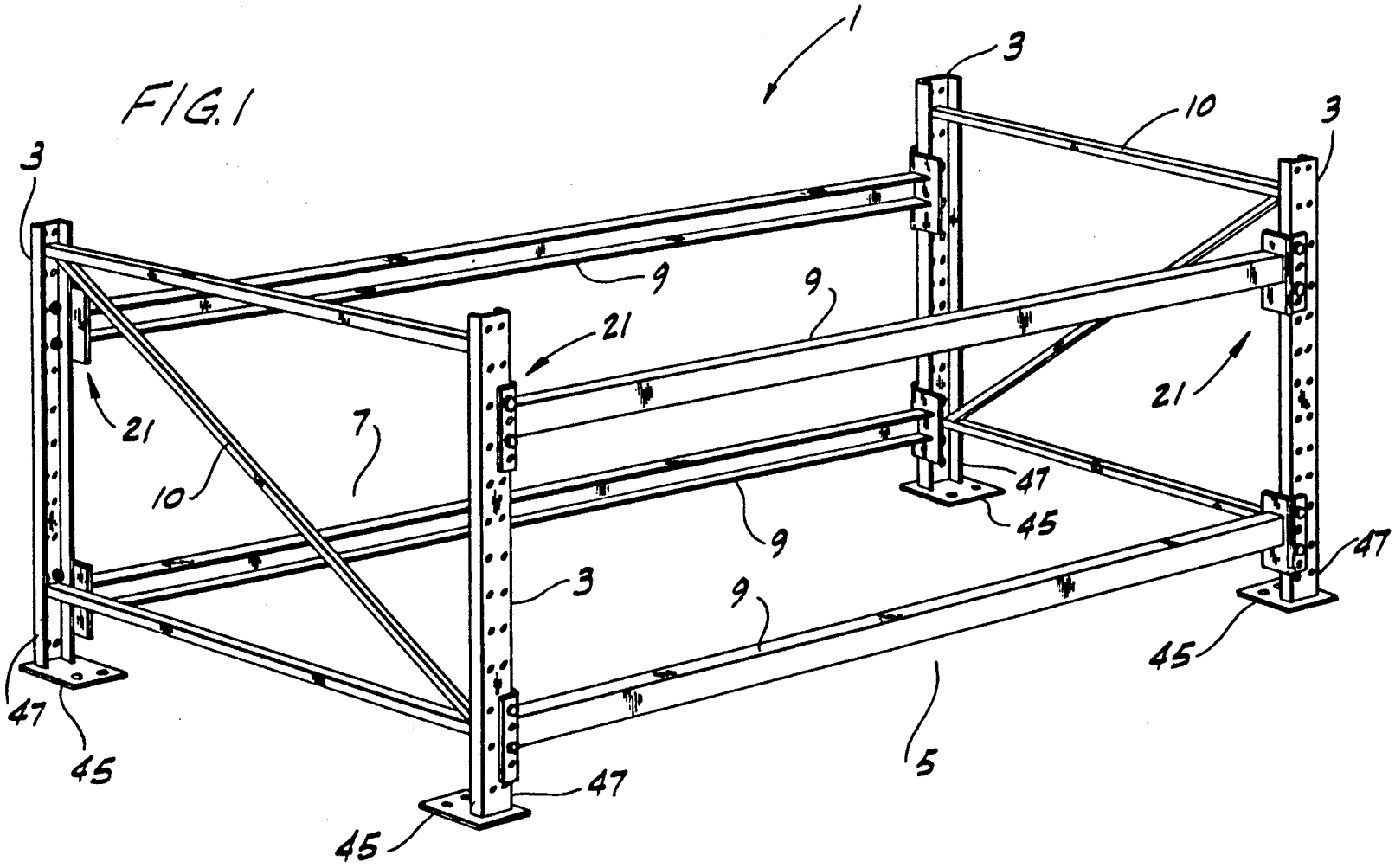
FIG. 1 is a perspective of a storage rack embodying the present invention.

Referring now to the drawings, there is generally indicated at 1 a storage rack as erected using connectors of this invention. As shown in FIG. 1, the rack comprises four vertically extending posts 3 arranged so that they are located at the corners of a rectangle. Connecting the two Posts at each of the long sides 5, 7 of the rectangle are beams 9 for supporting shelves (not shown) which may be used for supporting articles. FIG. 1 shows two beams at each of the long sides; however, it is understood that additional beams may be provided for additional sturdiness and storage space and still fall within the scope of the present invention. Beams 9 may be standard structural channel members or of any other suitable transverse cross-sectional shape depending on the structural capacity desired. Braces 10 connecting the short sides of the rectangle between the two end posts of the rack may be included for adding additional structural reinforcement. Each post 3 is of such transverse cross section as to have a first face 11 facing toward the opposite one of the rectangle and a second face 13 at generally a right angle to the first face 11. Thus, for example, each post may comprise a structural channel member as hereinafter described.

Figure 3:
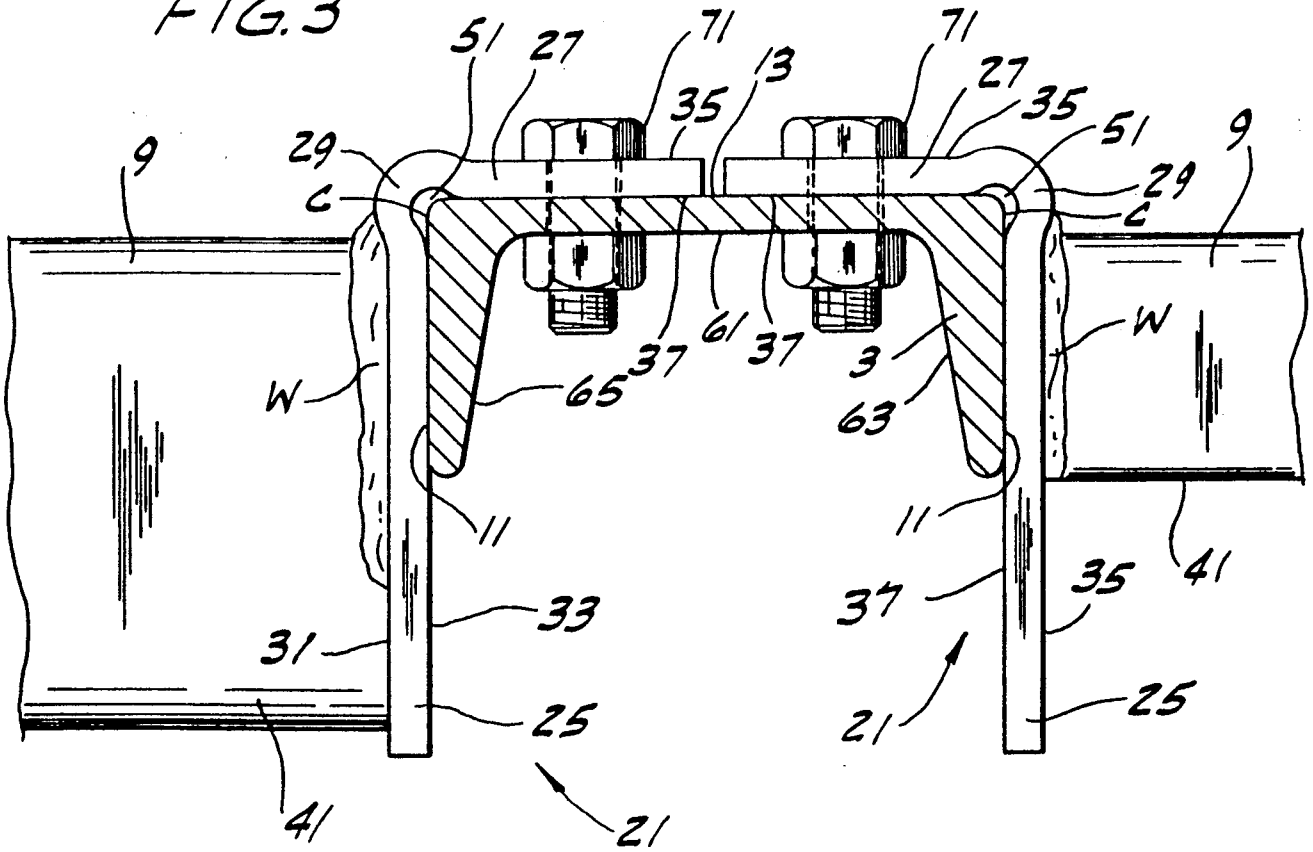
FIG. 3 is an enlarged cross-sectional view taken along the line 3—3 of FIG. 2.

At each end of the beam, means is provided for connecting that end of the beam to the respective post comprising connector 21 of this invention. Each connector 21, which may extend above and below the respective beam 9, comprises a generally rectangular metal plate 23 bent to angle shape in transverse section along a line A (see FIG. 4) extending from one end of the plate to the other to have first and second legs 25 and 27 generally at right angles to one another. As shown in FIG. 3, the second leg 27 is narrower in width than the first. Along line A (at the junction of legs 25, 27) is a bulged-out juncture 29. Leg 25 has an outside surface 31 and an inside surface 33, and leg 27 similarly has an outside surface 35 and an inside surface 37. The first leg 25 of each connector 21 is secured at the outside surface 31 thereof to an end 41 of a respective beam 9 with the connector extending transversely with respect to the beam above and below the beam and with the leg 27 extending out from the end of the beam. Similarly, at the other end 41 of beam 9, another connector 21 is secured at the end of the beam so that the beam may be connected between two posts 9.

In the present embodiment, each metal connector 21 is welded to the respective metal beam 9 as indicated at W, it being understood that other means for connecting the members together may be used. The second leg 27 extends outwardly from the end of the beam 9 in a vertical plane parallel to the vertical endwise plane of the beam and at a right angle to first leg 25. The inside surface 33 of the first leg 25 engages the first face 11 of post 3 flatwise, and the inside surface 37 of second leg 27 engages the second face 13 of post 3 flatwise.

Figure 6:
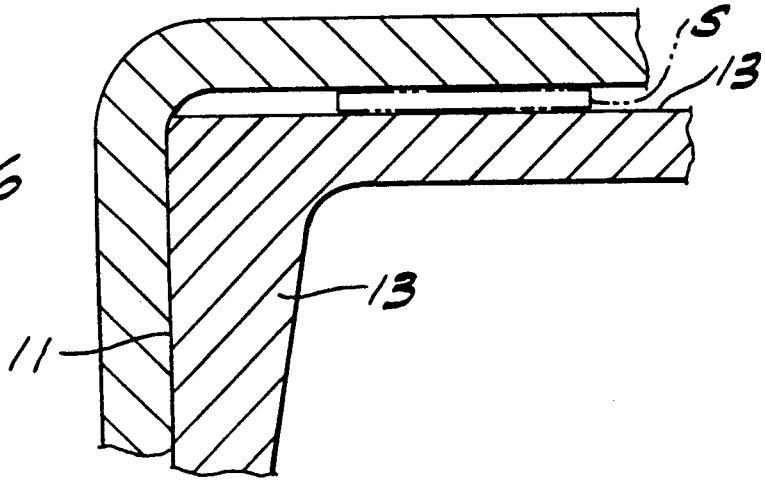
FIG. 6 is an enlarged view in section similar to FIG. 3 showing a connector made with a conventional juncture of its legs without the bulged-out feature incurs problems in fitting the connector to a post.

Referring to FIG. 3, the bulged-out juncture 29 is shown as of generally part-circular shape in transverse cross-section concave toward the inside surfaces 33, 37 of the bent plate 23. The bulged-out juncture 29 is generally symmetrical about a vertical plane diagonally intersecting the juncture of the legs 25, 27 and provides a space 51 for clearance of the juncture 29 from the corner C of the post 3 where the faces 11 and 13 meet to allow flatwise engagement of the face 33 of leg 25 of the connector with the respective flat outside face 11 of the post and conjoint flatwise engagement of the face 37 of leg 27 of the connector with the flat outside face 13 of the post, providing for a snug fit of the connector with the post. Here it may be observed that if the connector were formed without the bulged-out juncture, but with a simple non-bulged-out juncture of the legs of the connector having a fillet at the inside of the juncture, the fillet would interfere with flatwise engagement of the inside faces of both legs of the connector with the post and may require use of a shim as shown at S in FIG. 6.

Each post 3 may comprise a structural metal channel member of standard C-shape section having a web 61 and first and second flanges 63, 65. The aforementioned first face 11 of the Post 3 is the outside face of a flange and the aforementioned second face 13 is the outside face of the web 61. Upon engagement of a connector 21 with the channel, the inside surface 33 of the first leg 25 of the connector is in flatwise engagement with the outside face 11 of a flange of the channel and the inside face 37 of the second leg 27 of the connector is in flatwise engagement with the outside face 13 of the web 61.

Figure 2:
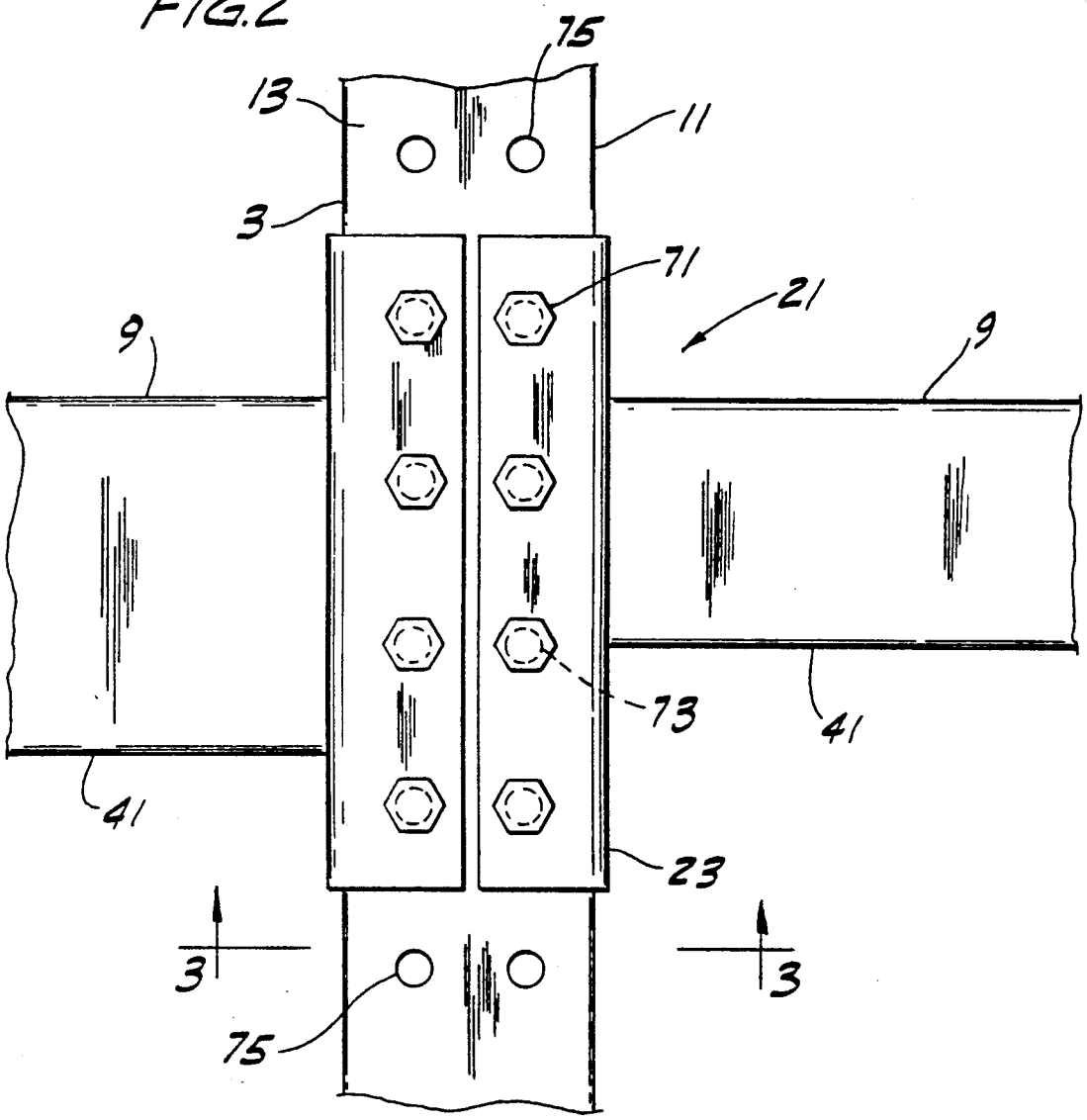
FIG. 2 is a view in elevation showing two beams and the connect for attaching them to a post.

Bolt and nut fasteners 71 fasten the second leg 27 of each connector 21 to the post 3. As shown in FIG. 2, bolt holes 73 are provided through the second leg 27 of each connector, these holes 73 being registered with bolt holes 75 in web 61 of post 3. Rows of bolt holes 75 in both flanges of post 3 allow multiple storage racks to be erected depending upon the amount of storage space desired. A base plate 45 is provided at the bottom end 47 of each post 3 for holding the posts in position at the corners of the rectangle and this may have holes 49 for accepting fasteners for securing the base plate 45 to the floor on which it is resting.

Figure 4:
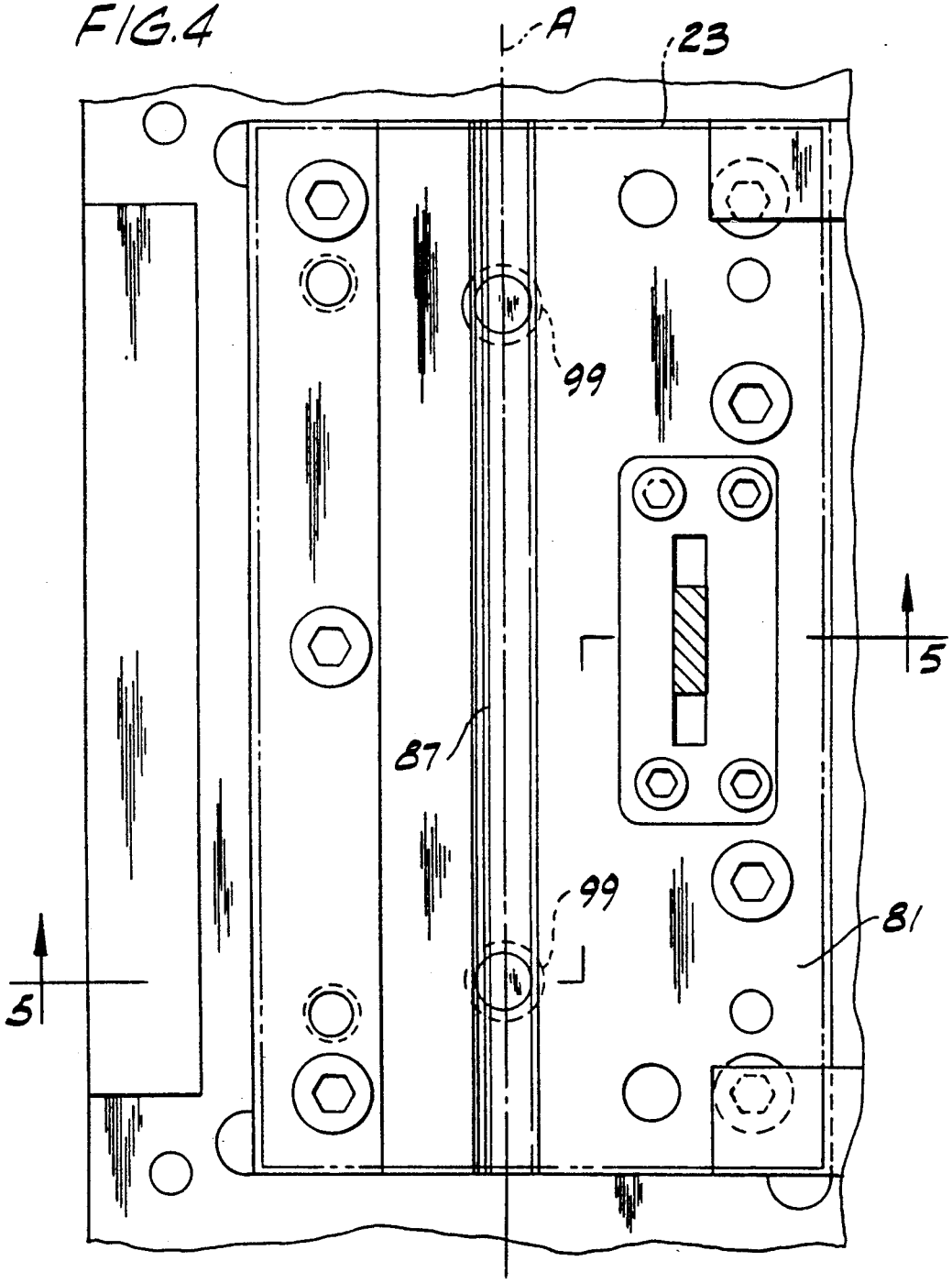
FIG. 4 is a plan view showing a die of a tool and die set for forming the connectors.
Figure 5:
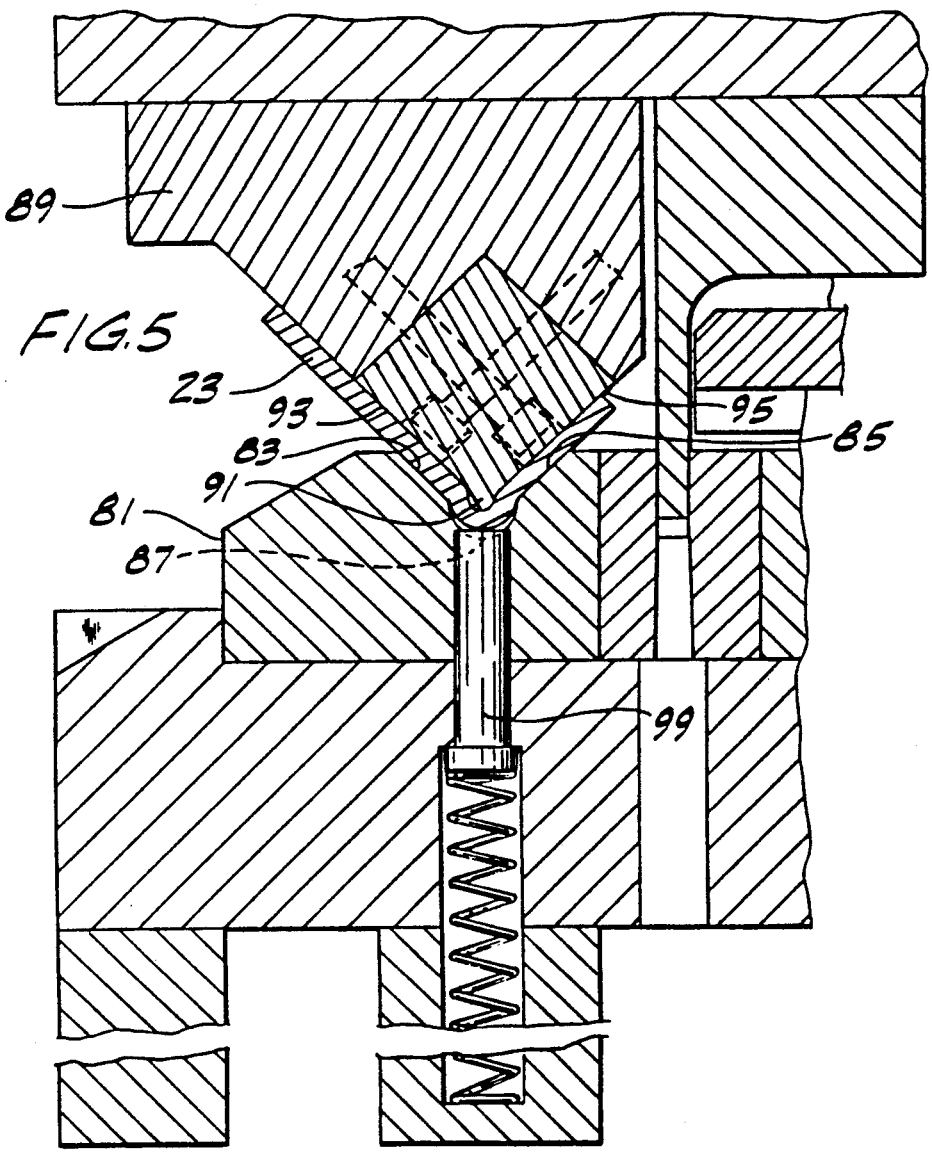
FIG. 5 is view in section taken along line 5—5 of FIG. 4 showing tool and die used to make connectors of the present invention.

Connector 21 may be made according to a method of this invention by bending the sheet metal plate 23 along longitudinal line A to form the right angle between first and second legs 25, 27, and concomitantly applying Pressure to the juncture of the legs to bulge out the juncture at 29. Referring to FIGS. 4 and 5, there is shown a die 81 having a generally V-shaped cavity defined by sloped surfaces 83, 85 which are generally perpendicular to one another, and a recess 87 of semicircular cross section at the intersection of the surfaces 83, 85 for shaping the bulged out juncture 29 of the legs of the connector. The sloped surfaces 83, 85 of the die flare out from the margins of the recess 87. Juncture 29 is pressed into the recess 87 by an elongate tool 89 (see FIG. 5) extending lengthwise of the juncture and having a cross section for pressing the sheet metal of the plate 23 into engagement with the faces 83, 85 of the die and into the recess. More specifically, tool 89 has an elongate tip 91 with a partcircular surface correlated with the recess 87, and inclined surfaces 93, 95 on opposite sides of the tip 91 correlated with the surfaces 83 and 85 of die 81. Bolt holes 73 are provided in leg 27 of plate 23 while flat before it is bent and provided with the bulged-out juncture 29.

In the manufacture of the connectors, a plate 23 in its initial flat condition travels along a conveyor (not shown) along a path in which a number of operations are performed at successive stations, including punching holes 73, until it reaches the station where it is bent and the bulged-out juncture is formed. With the flat plate brought between tool and die 89, 81, the tool 89 is brought downward to apply pressure along line A for bending the plate. Legs 25, 27 of the connector are formed by being pressed into flatwise engagement with surfaces 83, 85 of the die by surfaces 93, 95 of the tool. Pressure continues until the tip 91 forces the metal of plate 23 into recess 87 thereby forming the bulged-out juncture 29 and creating the right angle desired between legs 25, 27. After the tool 89 is moved away from the die 81, strippers 99 remove the bent plate 23 from the die.

In view of the above, it will be seen that the several objects of the invention are achieved and other advantageous results attained.

As various changes could be made in the above constructions and methods without departing from the scope of the invention, it is intended that all matter contained in the above description as shown in the accompanying drawing shall be interpreted as illustrative and not in a limiting sense.

What is claimed is:

1. A rack comprising four vertical posts arranged at the corners of a rectangle, at least one beam extending horizontally between the two posts at each of the long sides of the rectangle, each post being of such transverse cross section as to have a first face facing toward the opposite end of the rectangle and a second face at right angles to the first face, means for connecting each beam at each end thereof to the posts, and means for holding the posts in position at the corners of the rectangle, said connecting means comprising a metal plate bent to angle shape in transverse section to have first and second legs at right angles to one another and a bulged-out juncture for the legs, the first leg of each connecting means being secured at the outside thereof to the end of the respective beam extending transversely with respect to the beam at right angles to the beam with the inside face of said first leg in flatwise engagement with the said first face of the post, the second leg of each connecting means extending outwardly from the end of the beam in a vertical plane parallel to the vertical endwise plane of the beam with its inside face in flatwise engagement with the second face of the post, and means for fastening the second leg of each connecting means to the post.

2. A rack as set forth in claim 1 wherein the bulged-out juncture for the legs is generally of part-circular shape in transverse cross-section concave toward the inside of the bent plate.

3. A rack as set forth in claim 2 wherein the bulged-out part-circular juncture is symmetrical about a vertical plane diagonally intersecting the angle of the legs.

4. A rack as set forth in claim 1 wherein each post comprises a structural metal channel member having a web and first and second flanges, the said first face of the post being the outside face of the first flange of the post and the second face of the post being the outside face of the web of the post, and wherein the inside face of said first leg of each connecting means is in flatwise engagement with the outside face of the first flange, and the inside face of the second leg of each connecting means is in flatwise engagement with the outside face of the web.

5. A rack as set forth in claim 4 wherein the second leg of each connecting means is fastened to the respective post by bolts extending through bolt holes in the second leg and the web.

6. A rack as set forth in claim 5 wherein the second leg of each connecting means is narrower than the first leg.

7. A rack as set forth in claim 6 wherein the beam is a metal beam, each connecting means having its first leg welded to the respective end of the beam.

8. A rack as set forth in claim 7 wherein each connecting means extends above and below the respective beam.

9. A member for connecting of the end of a beam to a vertical post of a rack comprising a sheet metal plate originally of rectangular shape bent along a line extending from one end of the plate to the other to be of angle shape in transverse cross section thereby having first and second legs at right angles to one another, and further having a bulged-out juncture for the legs.

10. A member as set forth in claim 9 wherein the bulged-out juncture for the legs is generally part circular in transverse cross section concave toward the inside of the bent plate.

11. A member as set forth in claim 10 wherein the bulged-out part circular juncture is symmetrical about a vertical plane diagonally intersecting the juncture of the legs.

12. The method of making a connecting member as set forth in claim 9 comprising bending the sheet metal Plate along said line to form it to the angle shape in transverse section with the said first and second legs, and applying pressure to the juncture of the legs to bulge out the juncture.

13. The method of claim 12 wherein the plate is backed by a die having a recess for shaping the bulged-out juncture of the legs, the juncture being pressed into the recess by an elongate tool extending lengthwise of the juncture having a cross section for pressing the sheet metal of the plate into engagement with the surface of the die in the recess.

14. The method of claim 12 wherein the recess is generally of semi-circular cross section.

15. The method of claim 14 wherein the die has surfaces flaring out from the recess at right angles to one another for forming the legs.

16. The method of claim 15 wherein the tool has an elongate tip with a part-circular surface cross-section correlated with the recess and having surfaces on opposite sides of the tip correlated with the flaring surfaces of the die.

17. The method of claim 12 wherein holes for fasteners are provided in one of the legs of the plate before the bending of the plate and bulging out of the juncture.

* * * * *